US007886946B2

(12) United States Patent
Gray

(10) Patent No.: US 7,886,946 B2
(45) Date of Patent: Feb. 15, 2011

(54) BABY CARRIER

(76) Inventor: Jeanette Edith Gray, 1781 N. 620 East, Orem, UT (US) 84097

( * ) Notice: Subject to any disclaimer, the term of this patent is extended or adjusted under 35 U.S.C. 154(b) by 105 days.

(21) Appl. No.: 12/181,224

(22) Filed: Jul. 28, 2008

(65) Prior Publication Data

US 2009/0026235 A1 Jan. 29, 2009

Related U.S. Application Data

(63) Continuation-in-part of application No. 11/611,857, filed on Dec. 16, 2006.

(51) Int. Cl.
*A47D 13/02* (2006.01)

(52) U.S. Cl. ..... 224/160; 224/159; 224/158; 224/259; 224/260

(58) Field of Classification Search ..... 224/158, 224/159, 160, 161, 258, 259, 262, 601, 602, 224/627, 631, 637, 643, 647, 656
See application file for complete search history.

(56) References Cited

U.S. PATENT DOCUMENTS

| | | | | | |
|---|---|---|---|---|---|
| 4,149,687 | A * | 4/1979 | Nunemacher | ..... | 224/159 |
| 4,434,920 | A * | 3/1984 | Moore | ..... | 224/160 |
| 5,020,709 | A * | 6/1991 | Hoaglan | ..... | 224/155 |
| 5,205,451 | A * | 4/1993 | Manzer | ..... | 224/161 |
| 5,361,952 | A * | 11/1994 | Gold | ..... | 224/159 |
| 5,673,828 | A * | 10/1997 | Raedel et al. | ..... | 224/160 |
| 5,678,739 | A * | 10/1997 | Darling et al. | ..... | 224/160 |
| 5,813,580 | A * | 9/1998 | Fair | ..... | 224/160 |
| 6,409,060 | B2 * | 6/2002 | Donine | ..... | 224/160 |
| 6,595,396 | B2 * | 7/2003 | Cummings et al. | ..... | 224/158 |
| 6,763,983 | B2 * | 7/2004 | Norman | ..... | 224/160 |
| 2004/0149790 | A1 * | 8/2004 | Kassai et al. | ..... | 224/160 |

OTHER PUBLICATIONS

Kapoochi "One Step Ahead: Thoughtfully Selected Products to Help With Baby . . . Every Step of the Way." Preferred Issue 1999. Kapoochi. <http://www.kapoochi.net/Merchant2/merchant.mvc?Screen=PROD&Store_Code=KB-1&Product_Code=24900& Category_Code=Kapoochi_0001> May 10, 2010.

* cited by examiner

*Primary Examiner*—Nathan J Newhouse
*Assistant Examiner*—Steven M Landolfi, Jr.

(57) ABSTRACT

A baby carrier comprising a shoulder harness featuring a detachable adjustable pouch system that may be worn or alternatively fastened to a secured object for supporting an infant. The detachable adjustable pouch may also feature a detachable adjustable support waist belt that may be worn by the wearer. The shoulder harness features retractable shoulder straps that may be used to securely extend the detachable adjustable pouch system away from wearer without having to detach the pouch or remove the infant while simultaneously allowing the wearer face to face access with the infant. The detachable adjustable pouch system may encapsulate and support an infant in a substantially upright sitting position. The detachable adjustable pouch system may be adjusted to accommodate infants of varying sizes. The weight of the infant may be incorporated as a design component of the seat portion of the pouch system.

20 Claims, 7 Drawing Sheets

BABY CARRIER

CROSS REFERENCES

This patent application is a continuation-in-part of U.S. patent application Ser. No. 11/611,857 filed on Dec. 16, 2006 and entitled 'Baby Carrier', which is herein incorporated by reference in its entirety.

BACKGROUND OF THE INVENTION

The present invention relates to an improved soft baby carrier in which an infant can be safely carried by its parent or fastened to a secure object. One of the many situations which a modern-day parent has to contend with is trying to manage everyday activities while also trying to care for their infant child. Many parents may find themselves in a predicament where they have to temporarily forego whatever activity they are currently engaged in while they tend to the needs of their little one. Various baby carriers have been developed over the years as a means of allowing parents to accomplish many of these activities simultaneously by providing a carrying arrangement attached to the parent that may allow the parent use of their arms to perform other activities as needed, while the infant is safely secured within the baby carrier. Soft baby carriers typically incorporate an arrangement of fabric or similar material that is formed to cradle an infant that may then be attached to the wearer. Some arrangements may be worn on the front, side or back of the torso depending on the design. Despite various improvements over the years, many soft baby carriers still lack ease of use and the ability to be adjusted quickly to accommodate infants and parents of different sizes and shapes.

U.S. Pat. No. 5,361,952 by Gold, which is herein incorporated by reference for all that it contains, discloses a soft-type baby carrier for supporting a baby in a rearwardly facing direction on the front or side torso of a wearer. The baby carrier includes an adjustable pouch shaped baby seat for supporting a baby in a substantially upright, sitting position, an adjustable waist belt and an adjustable yoke system for comfortably supporting the baby carrier about the neck of a wearer. U.S. Pat. No. 7,070,076 by Bergkvist, which is herein incorporated by reference for all that it contains, discloses pertaining to a child-supporting shoulder harness including a flexible front piece which is connected in the harness to form a child supporting pouch. The front piece includes a length-adjustable connecting device which extends between two horizontal, mutually spaced points on the front 5 piece, so as to enable the width of the pouch to be varied. When the width is reduced, the lateral end parts of the front piece are deformed in a way that reduces the wedging action between the wearer's chest and the baby's head and provides a comfortable lateral head support for a sleeping baby.

BRIEF SUMMARY OF THE INVENTION

The present invention comprises an improved soft baby carrier comprising an adjustable shoulder harness featuring a detachable adjustable pouch system and a detachable adjustable support waist belt that attaches to the pouch system. The baby carrier maybe worn or alternatively fastened to a secured object for supporting an infant. The detachable adjustable pouch system may also be detached from the shoulder harness and fastened to a secure object for supporting an infant. The support waist belt may also be worn independent of both the adjustable shoulder harness and the pouch system to support an infant on the wearer's hips.

In one aspect of the invention the adjustable shoulder harness may incorporate retractable shoulder straps disposed in the front portion of the harness that may be used to safely and securely extend the pouch system away from the wearer without having to detach the pouch or remove the infant. The retractable shoulder straps may allow the pouch system to be quickly and conveniently extended away from the wearer providing face to face interaction with the infant while also creating extra room for the infant to move. The pouch may also be retracted just as quickly into its original position once the needs of the infant are addressed or at such time that the infant is once more settled, allowing the parent to carry on with the task at hand.

In another aspect of the invention the detachable adjustable pouch system may form a seat for supporting an infant in a substantially upright seated position that may be adjusted to accommodate an infant of varying sizes. The pouch may be adjusted to fit an infant by utilizing a retractable drawstring system disposed in the seat portion and adjustable straps disposed in the side portions both of which may be adjusted to provide more or less depth and width for the infant. The adjustable pouch system may also incorporate the weight of the infant as a design feature of a fastening system in the seat portion.

In yet another aspect of the invention the detachable adjustable support waist belt may be attached to the pouch system to provide extra support to the infant and reduce the amount of load bearing on the adjustable shoulder straps over the wearer's shoulders and provide improved postural support for the wearer by distributing the load to the hip area. The support waist belt may be also be worn completely independent of the baby carrier and used to support the infant solely around the hips.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following, more detailed description of embodiments of the apparatus of the present invention, as represented in the Figures is not intended to limit the scope of the invention, as claimed, but is merely representative of various selected embodiments of the invention.

Figure 1:
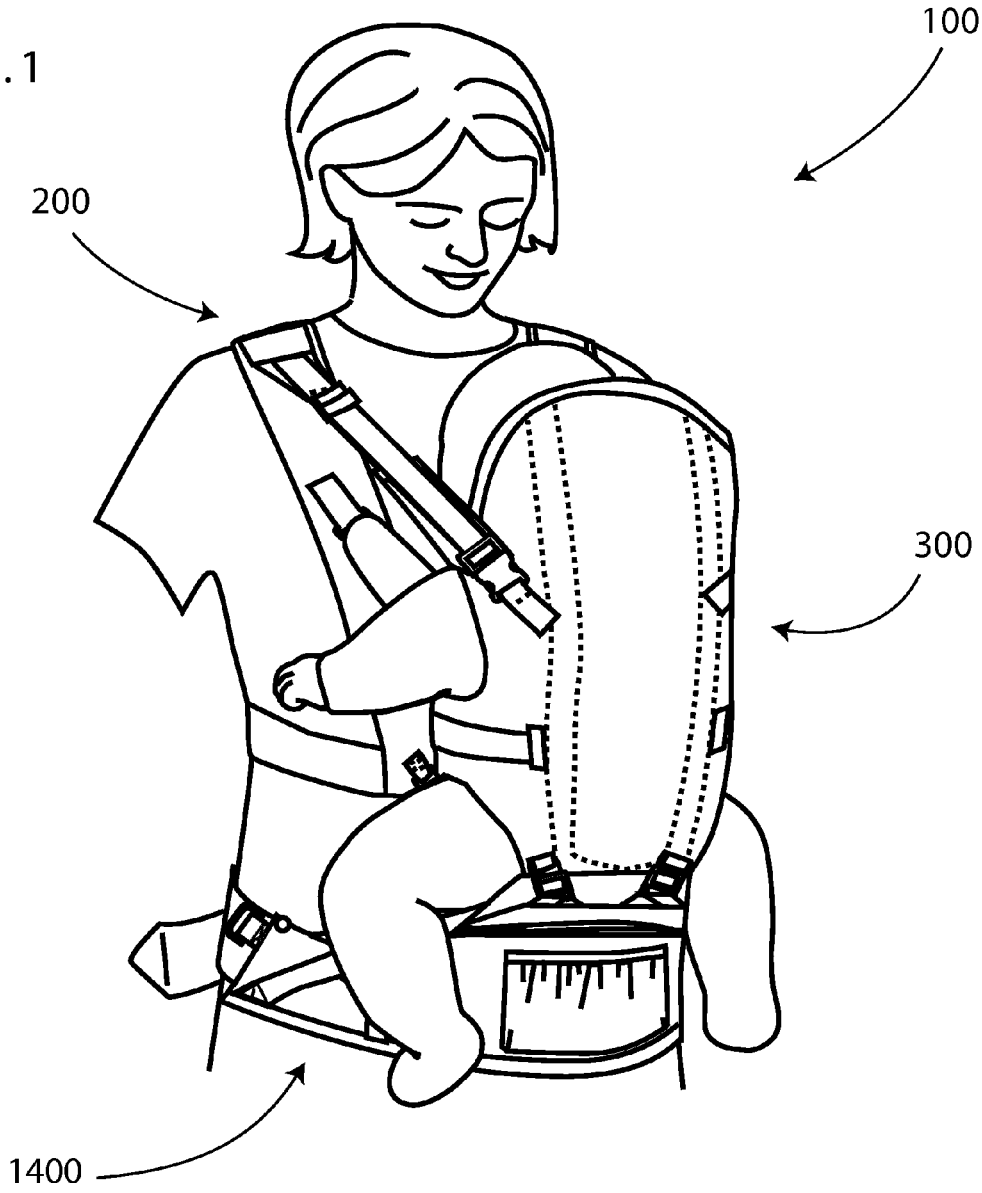
FIG. 1 is a perspective diagram of an embodiment of a baby carrier.
Figure 2:
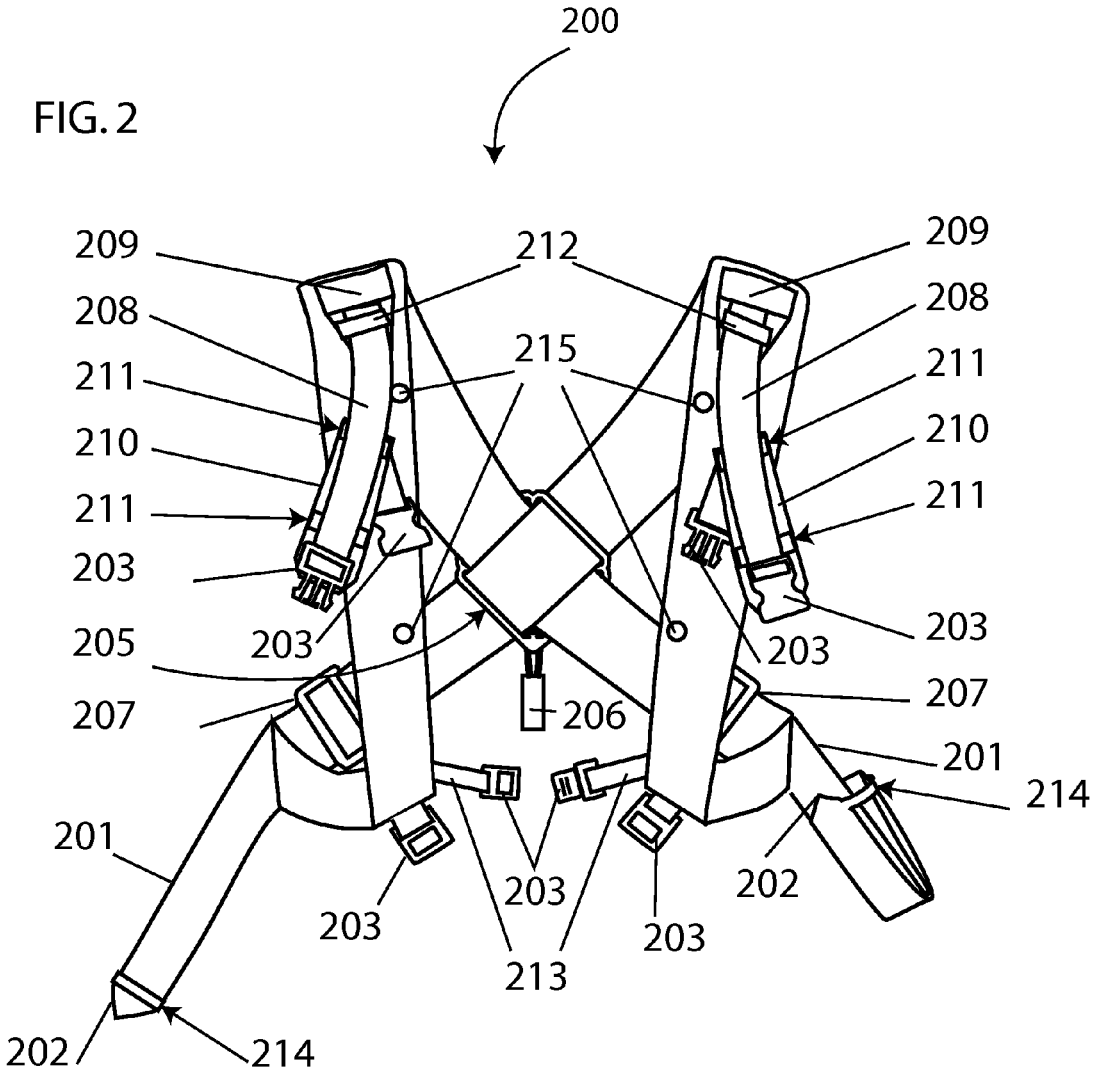
FIG. 2 is a perspective diagram of an embodiment of an adjustable shoulder harness.

FIG. 1 discloses an embodiment of the current invention depicting a soft baby carrier 100 comprising an adjustable shoulder harness 200 and a detachable adjustable pouch system 300 with a detachable adjustable support waist belt 1400 attached to the detachable adjustable pouch system 300 in which an infant can be safely carried by its parent or fastened to a secure object. FIG. 2 discloses an embodiment of the current invention depicting an adjustable shoulder harness 200. The shoulder harness 200 may comprise an arrangement of at least two adjustable straps 201 comprising two ends 202, a front and rear portion, with a plurality of fastening fixtures 203 disposed at the front portion of said arrangement. In some embodiments the arrangement may comprise at least two adjustable straps 201 that form a figure 8-shaped arrangement. The two adjustable straps 201 may comprise thick padded fabric of substantially equally lengths. The two adjustable straps 201 may intersect through an intersection 205 that may also comprises an appendage 206 attached to the intersection 205 disposed towards the rear portion of the arrangement that may be utilized to hold the shoulder harness 200 in conformity. The thick padded fabric may serve to cushion both the wearer and the infant while the intersection 205 may assist to hold the arrangement in place, providing both fit and comfort during long periods of use. The two adjustable straps 201 may comprise buckles 207 disposed towards the rear of portion of the arrangement that are utilized to provide slack or take up any excess slack in the arrangement such that the shoulder harness 200 conforms to the torso of the wearer. The plurality of fastening fixtures 203 may be disposed generally at the front portion of the shoulder harness 200 and may comprise male or female connections selected from the group consisting of plastic domes, metal domes, plastic clips, metal clips, plastic hooks, metal hooks or combinations thereof. In a preferred embodiment the plurality of fastening fixtures 203 may comprise plastic clips that may also be configured to complement the at least one fastening fixtures of the detachable adjustable pouch system (not shown).

Also depicted are the at least two retractable shoulder straps 208 that may be disposed at the front of the adjustable shoulder harness 200 comprising separate fastening fixtures 203 at each end. In some embodiments the separate fastening fixtures 203 disposed at the end of the at least two retractable shoulder straps 208 may comprise a means to enable each end to be extended or retracted. In a preferred embodiment the at least two retractable straps 208 may comprise nylon strapping attached to a piece of fabric 209 subsequently attached in the upper portion of the adjustable shoulder harness 200. The piece of fabric 209 may be utilized to enable the at least two retractable shoulder straps 208 to withstand the effects of separating from the shoulder harness 200 after prolonged usage. The at least two retractable straps 208 may further comprise a sliding padded rectangular fabric strip 210 that may be attached using loops 211 with stops 212 forming the ends. The loops 211 may assist to keep two retractable straps 208 secure while the stops 212 may prevent the two retractable straps 208 from disconnecting from the shoulder harness 200. In some embodiments the fabric strips 210 may provide extra cushioning to prevent chaffing that may occur to an infant when the detachable adjustable pouch system (not shown) is attached to the adjustable shoulder harness 200.

Two small fastening fixtures 203 may be configured to connect at a lower front portion of the arrangement. The two small fastening fixtures 203 may be attached to elastic straps 213 that are attached at a lower portion of the arrangement. The two smaller fastening fixtures 203 may assist the shoulder harness 200 to conform better to the torso of the wearer and provide an improved fit. The two adjustable straps 201 may further comprise ends 202 with elastic straps 214 that may be utilized to secure any extra length of strap not being utilized. In other embodiments a bib (not shown) may be attached by plastic domes 215 disposed in the front portion of the shoulder harness 200 which may correspond to the chest area of the wearer. The bib may act as a shield between the infant and the wearer and prevent stains from lodging on the wearer's clothes.

Figure 3:
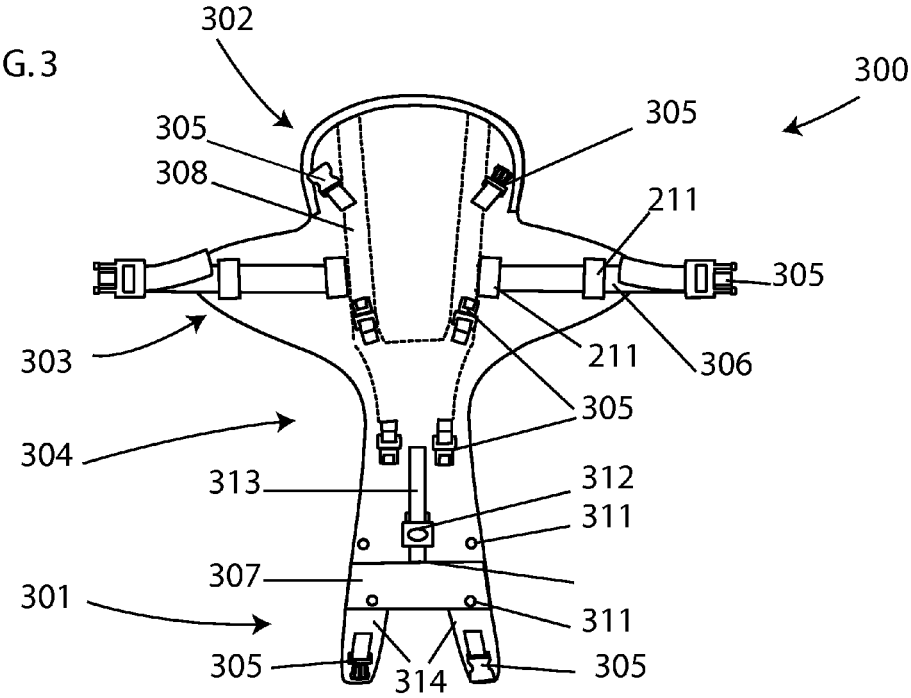
FIG. 3 is a perspective diagram of an embodiment of the detachable adjustable pouch system exterior.

FIG. 3 discloses another embodiment of the current invention depicting the exterior of a detachable adjustable pouch system 300 comprising a front 301, back 302, side 303 and seat 304 portions. Each portion may comprise at least one fastening fixture 305. The side portions 303 may comprise retractable straps 306 with fastening fixtures 305 disposed at each end. A retractable drawstring system 308 may be disposed within the back portion 302. The pouch system 300 may comprise padded fabric in a generally T-shaped configuration. The front portion 301 of the pouch system 300 may be formed towards the bottom of the T-shaped configuration and comprise a forked portion 314 that may further comprise at least one fastening fixture 305 that complements the at least one of the plurality of fastening fixtures 203 located on the shoulder harness. The forked portion 314 may further comprise a retractable partition 307 comprising padded fabric that may be extended and attached to plastic domes 311 in an upper portion of the forked portion 314 or retracted and secured using another set of plastic domes 311 in a lower portion of the forked portion 314. The retractable partition 307 may allow the pouch to extend to provide more depth in the seat portion 304 that may also allow more leg room for a larger infant and assist to keep the shoulder straps in place. A sliding fastening fixture 312 attached to a restraining loop 313 may also be disposed on the exterior of the front portion 301. The sliding fastening fixture 312 may be adjusted to connect with the at least one fixtures 305 disposed at the ends of the retractable straps 306 disposed in the side portions 303 of the pouch system 300 to accommodate an infant and provide a better fit.

The back 302 and side 303 portions of the pouch system 300 may be formed in the upper portion of the T-shaped configuration and may comprise at least one fastening fixture 305 that complements at least one of the plurality of fastening fixtures 203 located on the adjustable shoulder harness 200. The retractable straps 306 may comprise nylon straps attached to the back 302 portion of the pouch system 300. The retractable straps 306 may also comprise fabric loops 211 that may be utilized to secure any extra length of the nylon strap not be used to secure the infant in the pouch system 300. The seat 304 portion may be formed generally in the middle of the T-shaped configuration and may comprise at least one male fastening fixture 305 disposed on the exterior of said portion. In a preferred embodiment the seat portion 304 may comprise four male fastening fixtures 305 for connection with at least one of the plurality of fastening fixtures 203 of the adjustable should harness 200.

Figure 4:
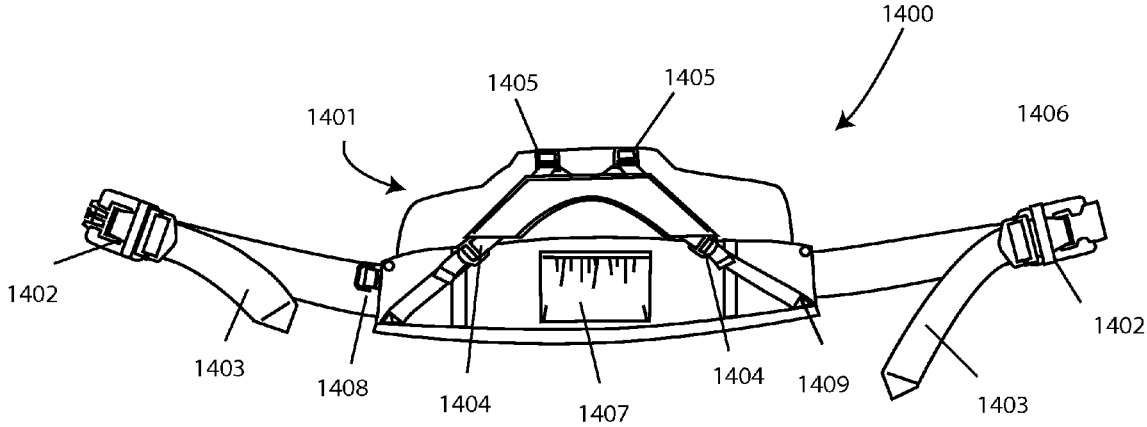
FIG. 4 is a perspective diagram of an embodiment of the detachable adjustable support waist belt.

FIG. 4 discloses an embodiment of a detachable adjustable support waist belt 1400 that may comprise a padded seat portion 1401 being generally disposed towards the upper back portion of said belt 1400 comprising at least one fastening fixture 1405 that may attach to said detachable adjustable pouch system 300. The detachable adjustable waist belt 1400 may further comprise an arrangement of at least two fastening fixtures 1402 disposed at the end of said belt 1400 that may connect at the front, side or rear of wearer. The fastening fixtures 1402 may further be disposed in front of a padded portion 1406 that may prevent the wearer from being pinched when the fastening fixtures 1402 are connected. In other embodiments the padded portion 1406 may also prevent chaffing around the waist when the baby carrier 100 or belt 1400 is being used. The belt 1400 may also comprise a means to adjust the diameter of the belt 1400 around the wearer to accommodate waists of varying sizes whereby pull straps 1403 may be either constricted or loosened depending on the needs of the wearer. In yet other embodiments the detachable adjustable support waist belt 1400 may provide added support for an infant and help to distribute the weight of the infant from the shoulders and more towards the wearer's hips. In some embodiments the belt 1400 may also comprise adjustable straps 1404 being disposed within the seat portion 1401 of the belt 1400 so as to provide a means to adjust the seat 1401 depending on the needs or size of the infant being carried. In some instances the adjustable straps 1404 may help to secure the infant while also providing improved posture for both the infant and the wearer by bringing the infant closer to the wearer. In other embodiments the belt 1400 may also comprise a storage pocket 1407 to carry various small items. The belt 1400 may also comprise additional clips 1408 for interfacing with other accessories.

Figure 5:
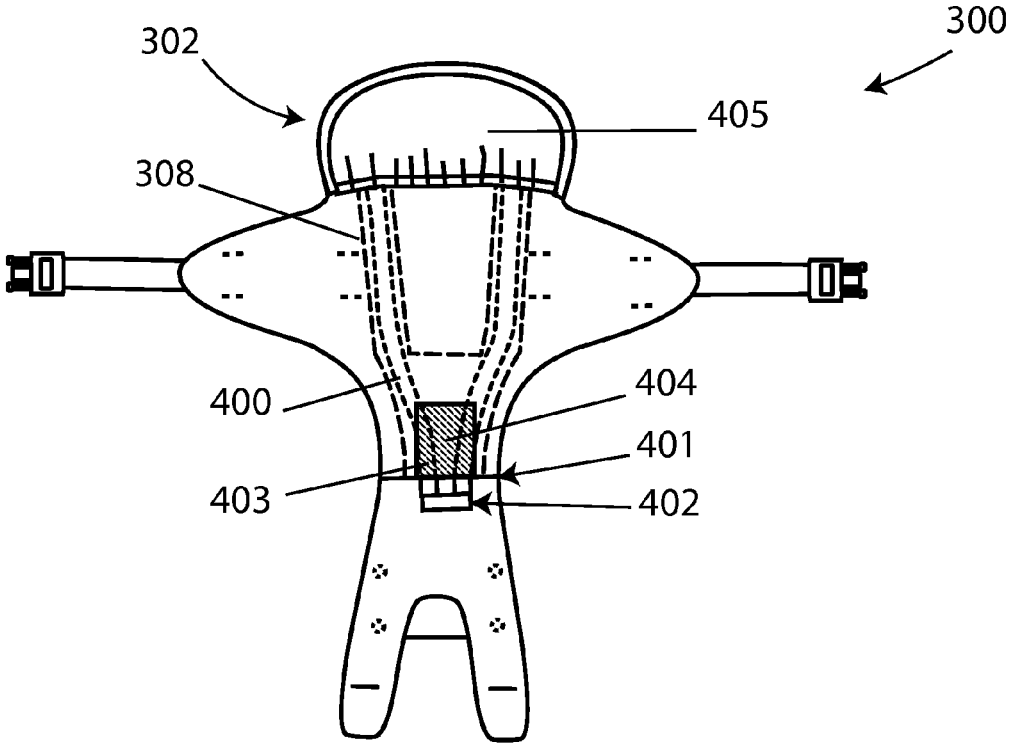
FIG. 5 is a perspective diagram of another embodiment of the detachable adjustable pouch system interior.

FIG. 5 discloses another embodiment depicting the interior portion of the pouch system 300 that may comprise a padded fabric that provides both comfort and warmth. The interior may be sufficiently void of any sharp or hard objects and lay substantially flat for receiving an infant. The embodiment also discloses the retractable drawstring system 308 which may further comprise retractable drawstrings 400 that may subsequently be disposed within channels that form a generally V-shaped configuration. The ends of the retractable drawstrings 400 may be attached and anchored to the back 302 portion of the pouch system 300. The channels may be formed to accommodate the retractable drawstrings 400 so they have limited movement in a selected direction. The retractable drawstrings 400 may be selected from the material consisting of string, fabric tubing, nylon strapping, or combinations thereof. The retractable drawstrings 400 may be attached at their ends to a portion of the back 302 portion of the pouch system 300 that extends to an opening 401 where a strip comprising a pull tab 402 is attached at the apex of the V-shaped configuration. The retractable drawstrings 400 may be pulled up to 10 inches in a downward direction towards the forked portion 314 of the pouch system 300 or alternatively retracted back to their original starting position. The retractable drawstrings 400 may also comprise strips of a self adhesive material 403 that begin proximate the pull tab 402 and extend up to 10 inches towards the back 302 portion. In some embodiments the self adhesive material 403 may comprise Velcro hooks. A corresponding self adhesive pad 404 may be attached to the interior seat 304 portion of the adjustable pouch system 300. In some embodiments the corresponding self adhesive pad 404 may comprise Velcro padding. The back 302 portion of the pouch system 300 may also comprise an elasticized band that forms a pocket 405 in which the pouch system 300 may be rolled and stowed away.

Figure 6:
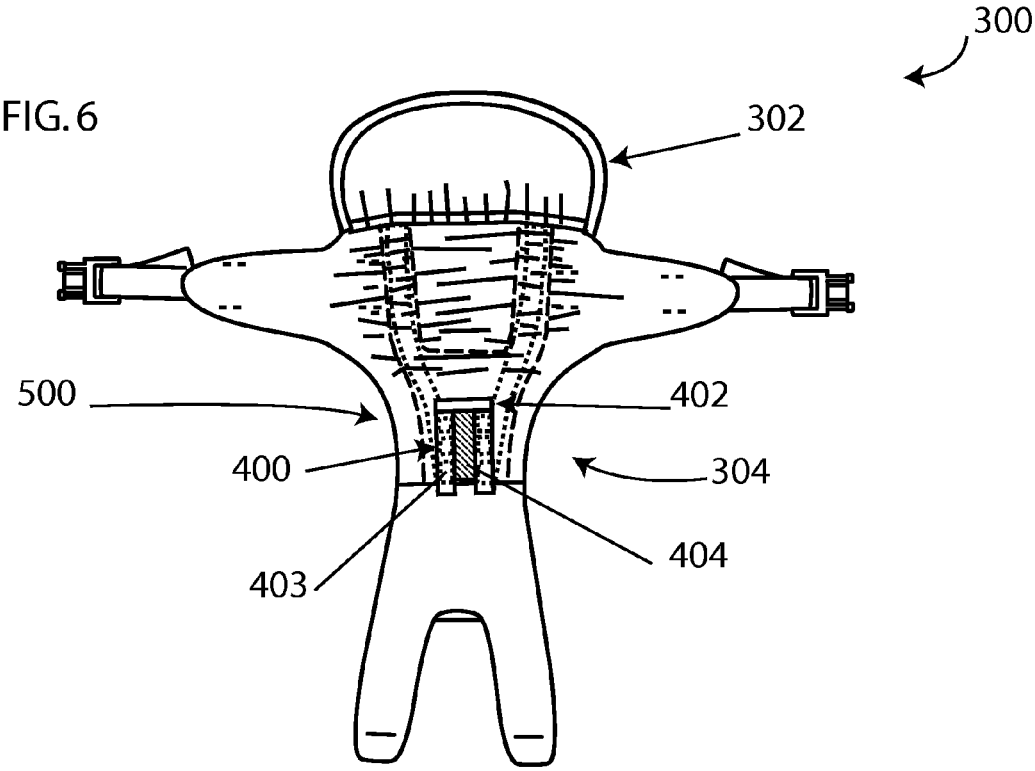
FIG. 6 is a perspective diagram of another embodiment of the detachable adjustable pouch system.

FIG. 6 discloses an embodiment of the detachable adjustable pouch system 300 depicting a fastening system 500 that may be utilized to adjust the depth of the pouch system 300. The fastening system 500 may comprise strips of self adhesive material 403 disposed on one side of the retractable drawstrings 400 that may be pulled and folded back towards the back 302 portion to be affixed to the self adhesive pad 404 disposed in the interior seat 304 portion of the pouch system 300. The fastening system 500 is disposed in the seat 304 portion of the pouch system 300 which may be disposed underneath the bottom of the infant and may utilized to incorporate the weight of the infant as a component to help keep the self adhesive material 403 and the self adhesive pad 404 affixed to one another. In some embodiments the fastening system 500 may also provide an extra layer of padding in the seat 304 portion.

Figure 7:
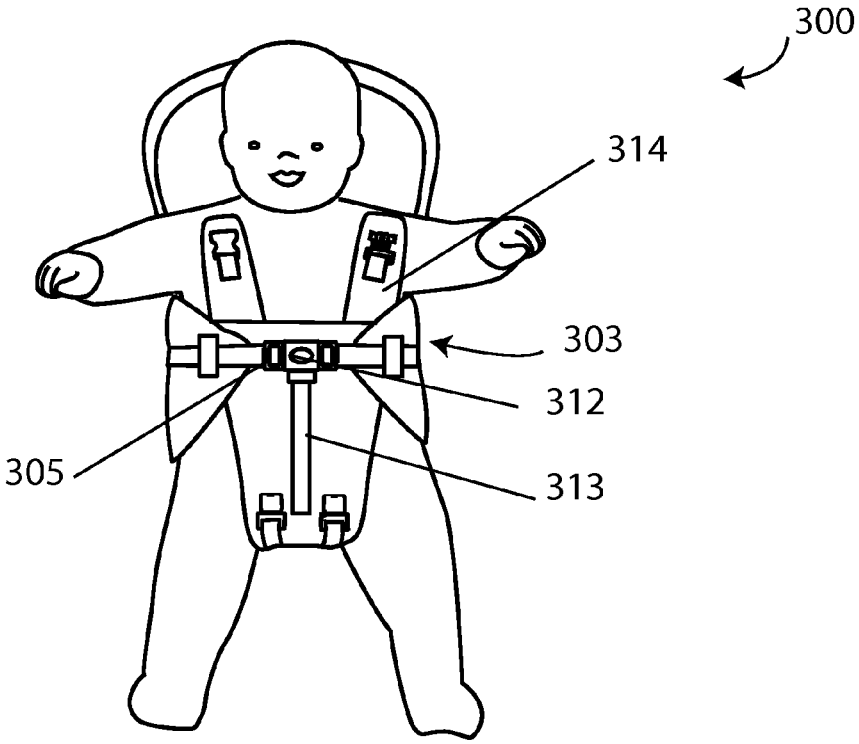
FIG. 7 is a perspective diagram of another embodiment of the detachable adjustable pouch system.

FIG. 7 discloses an embodiment of the baby carrier 100 depicting the adjustable pouch system 300 secured around an infant. In a preferred embodiment the pouch system 300 may comprise padded fabric in a generally T-shaped configuration with the front 301 portion being disposed towards the lower portion of the T-shaped configuration which may also comprise a forked portion 314. The forked portion 314 may be folded inwards towards the back 302 portion with the fastening fixtures 305 being disposed on the exterior of the pouch system 300. The side 303 portions may be formed in the upper portion of the T-shaped configuration and may be folded inwards to intersect with the forked portion 314. The embodiment further depicts how the T-shaped configuration may form the pouch system 300 that is utilized to support an infant. The side 303 portions may be used to wrap underneath the infants arms and around the torso while the fastening fixtures 305 disposed at each end may be configured to connect with the sliding fastening fixture 312 attached to the restraining loop 313 of the front 301 portion. In this embodiment the adjustable pouch system 300 may encapsulate and support an infant in a substantially upright sitting position that can be attached to the adjustable shoulder harness 200 or a secure object.

Figure 8:
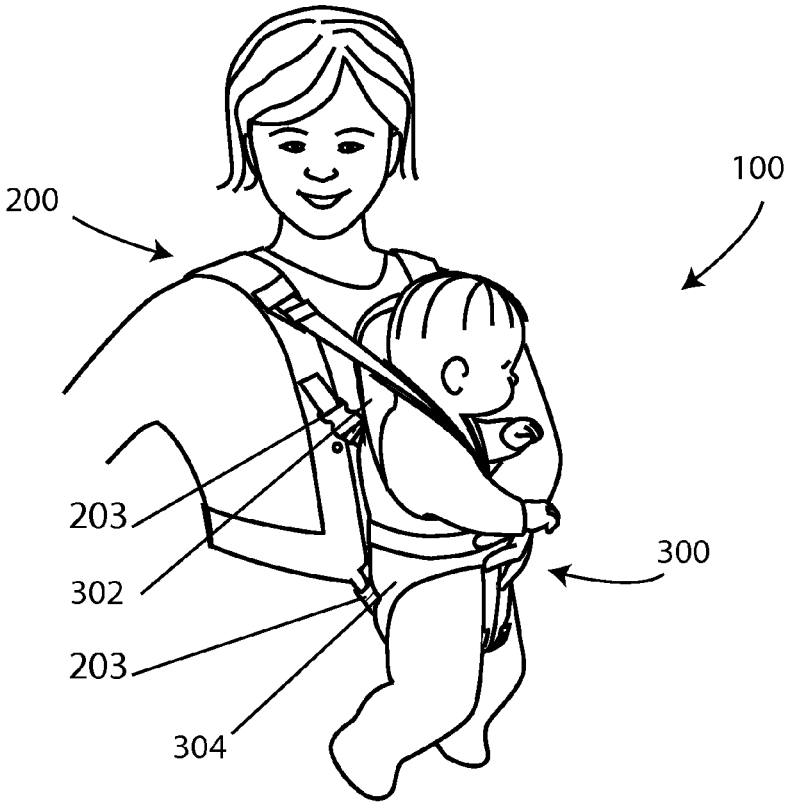
FIG. 8 is another perspective diagram of an embodiment of the detachable adjustable pouch system attached to the shoulder harness.
Figure 9:
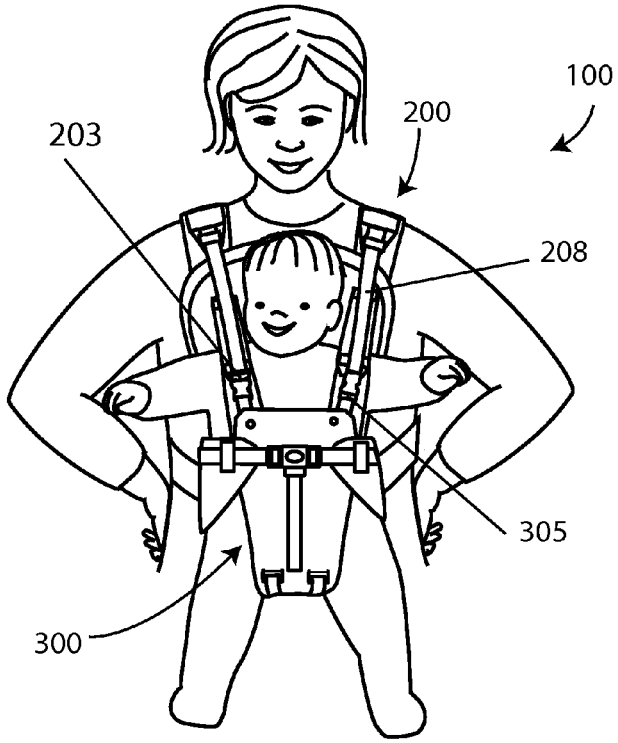
FIG. 9 is another perspective diagram of an embodiment of the detachable adjustable pouch system attached to the shoulder harness.

FIGS. 8-9 disclose an embodiment of the baby carrier 100 depicting the detachable adjustable pouch system 300 attached to the adjustable shoulder harness 200 in a forward facing position where the infant may be positioned forward facing. In this embodiment the adjustable pouch system 300 comprising the plurality of fastening fixtures 305 may be attached to the adjustable shoulder harness 200 using the at least one fastening fixtures 203. In a preferred embodiment the pouch system 300 may be attached to the adjustable shoulder harness 200 using twelve fastening fixtures which may comprise the separate fastening fixtures 203 disposed at each end of the at least two retractable shoulder straps 208 that complement two fastening fixtures 305 disposed in the forked portion 314 of the adjustable pouch system 300. Two fastening fixtures 203 disposed at the lower front portion of the adjustable shoulder harness 200 may be coupled with two fastening fixtures 305 disposed in the seat 304 portion of the pouch system 300. While two additional fastening fixtures 203 located intermediate the at least two retractable shoulder straps 208 and the lower portion of the adjustable shoulder harness 200 may be coupled with two additional fastening fixtures 305 disposed at the rear of the back 302 portion of the pouch system 300. Referring now to FIG. 8 which discloses a baby carrier 100 wherein the adjustable shoulder harness 200 comprising separate fastening fixtures 203 disposed at the end of the at least one retractable shoulder straps 208 may be coupled with the fastening fixtures 305 disposed in the forked portion 314 of the pouch system 300 in a forward facing position. In this embodiment the at least two retractable shoulder straps 208 may help to secure the upper torso area of an infant and prevent the child from falling out of the carrier.

Figure 10:
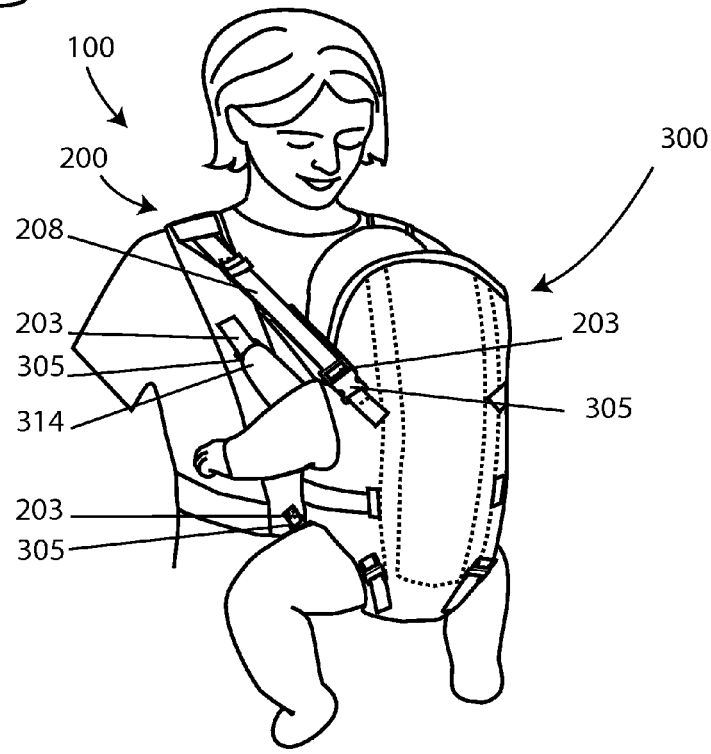
FIG. 10 is another perspective diagram of an embodiment of the detachable adjustable pouch system attached to the shoulder harness.
Figure 11:
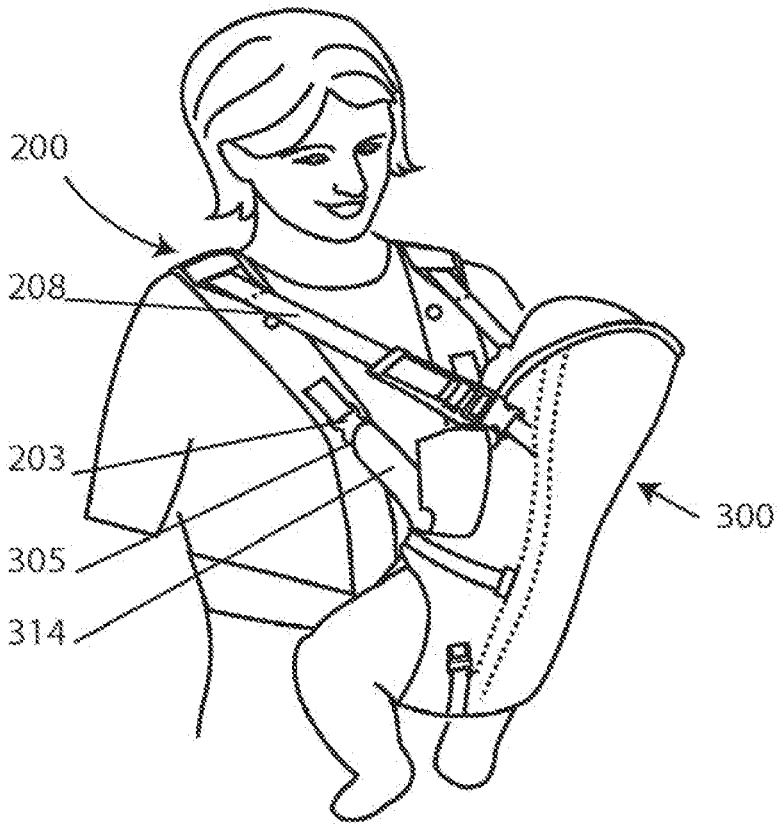
FIG. 11 is another perspective diagram of an embodiment of the detachable adjustable pouch system attached to the shoulder harness.

FIGS. 10-11 disclose an embodiment of the baby carrier 100 depicting the detachable adjustable pouch system 300 attached to the adjustable shoulder harness 200 in a rearward facing position where the infant may face towards the wearer. In a preferred embodiment the pouch system 300 may be attached to the adjustable shoulder harness 200 using a combination of fastening fixtures which may comprise the separate fastening fixtures 203 disposed at each end of the at least two retractable shoulder straps 208 coupled with the at least one fastening fixtures 305 disposed in the back 302 portion of the pouch system 300. The two fastening fixtures 203 disposed at the lower front portion of the adjustable shoulder harness 200 may be coupled with two fastening fixtures 305 disposed in the front of the seat 304 portion of the pouch system 300 while two more fastening fixtures 203 located intermediate the at least two retractable shoulder straps 208 and the lower portion of the shoulder harness 200 are coupled with the at least one fastening fixtures 305 disposed in the forked portion 314 of the adjustable pouch system 300. Referring now to FIG. 9 which depicts how the at least two retractable shoulder straps 208 may allow the pouch system 300 to be extended at least 2 inches from the adjustable shoulder harness 200. This may be accomplished by utilizing separate fastening fixtures 203 that comprise a means to extend or retract the at least two retractable shoulder straps 208, wherein the means may comprise one of the following consisting of a plastic sliding loop mechanism, a metal sliding loop mechanism, an elasticized member, an adjustable Velcro strap, or combinations thereof. The means may allow the pouch system 300 to be securely extended away from wearer without having to detach said pouch system 300 or remove the infant, while simultaneously allowing the wearer face to face access with the infant. In some embodiments the retractable shoulders straps 208 may allow the wearer quick face to face access to the infant in order to tend to the infants needs as well as provide extra room for the infant to move should the need arise.

Whereas the present invention has been described in particular relation to the drawings attached hereto, it should be understood that other and further modifications apart from those shown or suggested herein, may be made within the scope and spirit of the present invention.

What is claimed is:

1. A baby carrier comprising;

an adjustable shoulder harness comprising an arrangement of at least two adjustable straps, each strap having a shoulder portion configured for extending over a respective shoulder of a user, a front portion for extending over at least a chest of the user and a rear portion configured for extending around the back of the user, the at least two adjustable straps being laterally spaced along the front portions when positioned over the chest of the user;

a plurality of fastening fixtures coupled to each of the front portions of the shoulder harness, the plurality of fastening fixtures comprising a first pair of fastening fixtures, each coupled to a lower portion of a respective front portion and a second pair of fastening fixtures, each coupled to an upper portion of the respective front portion;

a third pair of fastening fixtures respectively coupled to a pair of selectively retractable and extendable shoulder straps the pair of shoulder straps each coupled at a first end to a respective shoulder portion of the harness and a second end coupled to a fastening fixture;

a detachable pouch comprising a front portion configured for extending over at least a portion of a front side of a torso of a child, a back portion including a head supporting portion configured for extending from a head of the child to a seat portion interposed between the front portion and the back portion, the seat portion configured to extend between the legs of the child, and laterally extending side portions extending laterally from the back portion configured to at least partially wrap around the torso of the child, the front portion comprising a first pair of corresponding fastening fixtures at a lower portion of the front portion for coupling to the first pair of fastening fixtures, a second pair of corresponding fastening fixtures at an upper portion of the front portion for coupling to the second pair of fastening fixtures, a third pair of corresponding fastening fixtures at the head supporting portion for coupling to the third pair of fastening fixtures, and a fourth pair of corresponding fastening fixtures at a lower portion of the back portion for coupling to the first pair of fastening fixtures when the pouch is coupled to the adjustable shoulder harness in a forward facing direction and wherein the third pair of fastening fixtures is configured to be coupled to the second pair of corresponding fastening fixtures of the pouch by extending the pair of selectively retractable and extendable shoulder straps over the shoulders of the child positioned in the forward facing direction; and a selectively attachable, removable and adjustable waist belt configured for being worn around a waist of the user comprising a waist belt seat portion configured for being positioned at least partially beneath the seat portion of the pouch and being generally disposed towards the upper portion of the waist belt, a pair of waist belt fastening fixtures coupled to said waist belt and configured to attach to said fourth pair of corresponding fastening fixtures when the pouch is in a rearward facing direction and to attach to said first pair of corresponding fastening fixtures when the pouch is in a forward facing direction, whereby at least a portion of the weight of the pouch can be carried by the waist belt.

2. The baby carrier of claim 1, wherein the waist belt seat portion is padded and depends from a top edge of the waist belt and has a length sufficient to extend to an outwardly facing side of a lower portion of the pouch.

3. The baby carrier of claim 1, wherein the waist belt comprises a padded front portion that extends between approximately the hips of the user.

4. The baby carrier of claim 1, further comprising at least one of a storage pocket and an accessory clip attached to the waist belt.

5. The baby carrier of claim 1, wherein the at least two adjustable straps form a figure eight, crossing at a rear portions of the straps, are adjustable in length proximate a lower portion of the back portions of each of the at least two adjustable straps so as to be adjustable by the user while wearing the harness and are of substantially equal length and further comprising an intersection device for holding the at least two adjustable straps in relative relation to each other where the at least two adjustable straps cross.

6. The baby carrier of claim 1, wherein the at least two selectively retractable and extendable shoulder straps are each disposed within the shoulder portions of the adjustable shoulder harness.

7. The baby carrier of claim 1, wherein the at least two selectively retractable and extendable shoulder straps comprise a means for extending or retracting the detachable adjustable pouch system at least 2 inches from the adjustable shoulder harness.

8. The baby carrier of claim 1, wherein the pouch system further comprises a padded fabric in a general T-shaped configuration and includes a forked front portion configured to extend at least partially over the shoulders of a child positioned within the pouch.

9. The baby carrier of claim 1, wherein the pouch comprises a sliding fastening fixture disposed on the exterior of the front portion attached to a restraining loop.

10. The baby carrier of claim 1, wherein the front portion of the pouch comprises a forked portion configured to extend up to proximately the shoulders of the child and wherein the third pair of corresponding fastening fixtures are coupled to the forked portion for attaching to the third pair of fastening fixtures of the harness when the child is in a forward facing direction.

11. The baby carrier of claim 1, further comprising side straps with fastening fixtures disposed at each end for securing the side portions of the pouch at least partially around the torso of the child.

12. The baby carrier of claim 1, wherein the waist belt further comprises a pair of straps each extending from opposite lower outward edges of the padded front portion to proximate an upper edge of the waist belt seat portion, the pair of waist belt fastening fixtures being coupled to respective ends of the pair of straps.

13. The baby carrier of claim 12, wherein the pair of straps extend diagonally across the waist belt and are at least partially disposed within the waist belt seat portion for being retained relative to the waist belt and for transferring at least some of the weight of the pouch to the waist of the user proximate the hips of the user.

14. The baby carrier of claim 1, wherein the pouch comprises a retractable drawstring system comprising retractable drawstrings disposed within channels that vertically extend through the pouch from proximate the seat portion to the head portion.

15. The baby carrier of claim 14, wherein the adjustable pouch system comprises a fastening system disposed in the seat portion for securing the retractable drawstring system relative to the seat portion.

16. The baby carrier of claim 14, wherein the retractable draw string system includes a pair of drawstrings in a V-shaped configuration with first ends coupled to the pouch in a laterally spaced manner proximate the head portion and the second ends extending through an opening in the pouch proximate the seat portion and coupled to a pull tab, whereby pulling on the pull tab causes the draw strings to pull the head portion closer to the seat portion to effectively shorten the length of the back portion of the pouch.

17. The baby carrier of claim 15, wherein the fastening system comprises strips of self adhesive material proximate an opening in the pouch with corresponding strips of self adhesive material attached to a pair of drawstrings so that when the pair of drawstrings is folded onto the strips of self adhesive material, the drawstrings can be held in place by the weight of the child bearing on the drawstrings.

18. A baby carrier comprising;

a shoulder harness assembly comprising a pair of straps, each having a shoulder portion configured for extending over a respective shoulder of a user, a front portion for extending over at least a chest of the user and a rear portion configured for extending around the back of the user, the at least two adjustable straps being laterally spaced along the front portions when positioned over the chest of the user and crossing in the back of the user;

a first pair of fasteners each releasably coupled to a lower portion of a respective front portion;

a second pair of fasteners each releasably coupled to an upper portion of the respective front portion;

a third pair of fasteners each releasably coupled to a selectively retractable and extendable shoulder strap, each shoulder strap attached at a proximal end to a respective shoulder portion of the harness and having a second end coupled to a fastening fixture;

a pouch configured to be removably attached to the shoulder harness assembly and formed of a relatively flat fabric structure having a generally star-shaped configuration when laid open and comprising a front portion configured for extending over at least a portion of a front side of a torso of a child, the front portion including forked upper ends that extend over the chest of the child to proximate the shoulders of the child, a back portion including a head supporting portion configured for extending from a head of the child to a seat portion interposed between the front portion and the back portion, the seat portion configured to extend between the legs of the child, and laterally extending side portions extending laterally from the back portion and configured to wrap around the torso of the child and buckle together in front of the child straps with fastening fixtures disposed at each end for securing the side portions at least partially around the torso of the child, a first pair of corresponding fasteners proximate the seat portion for coupling to the first pair of fasteners when the pouch is in a rearward facing direction;

a second pair of corresponding fasteners each coupled to one of the forked upper ends for coupling to the second pair of fasteners when the pouch is in a rearward facing direction and to the third pair of fasteners when the pouch is in a forward facing direction;

a third pair of corresponding fastening fixtures coupled to the head supporting portion for coupling to the third pair of fastening fixtures when the pouch is in a rearward facing direction;

a fourth pair of corresponding fasting fixtures coupled proximate the seat portion for coupling to the first pair of fasting fixtures when the pouch is in a forward facing direction;

whereby when the pouch is coupled to the shoulder harness with the child in a rearward facing arrangement the user can selectively extend or retract the pair of selectively retractable and extendable shoulder straps proximate the head of the child to allow the user to move the head portion of the pouch and thus the head and upper torso of the child toward or away from the user while maintaining support of the head of the child during the adjustment, the forked upper ends folding outwardly by the attachment of the second pair of corresponding fasteners to the second pair of fasteners to support the torso of the child.

an adjustable waist belt configured for being worn about a waist of the user comprising a front padded belt portion configured for extending at least between about the hips of the user, laterally extending attachment straps for securing the waist belt to the user, a seat support attached to the front portion of the waist belt configured for being positioned at least partially beneath the seat portion of the pouch and being generally disposed towards the upper portion of the waist belt, a pair of waist belt fastening fixtures coupled to said seat support and configured to attach to said fourth pair of corresponding fastening fixtures when the pouch is in a rearward facing direction and to attach to said first pair of corresponding fastening fixtures when the pouch is in a forward facing direction, whereby at least a portion of the weight of the pouch can be carried by the waist belt.

19. The baby carrier of claim 18, wherein the waist belt further comprises a pair of straps each extending from opposite lower outward edges of the padded front portion to proximate an upper edge of the waist belt seat portion, the pair of waist belt fastening fixtures being coupled to respective ends of the pair of straps.

20. The baby carrier of claim 19, wherein the pair of straps extend diagonally across the waist belt and are at least partially disposed within the waist belt seat portion for being retained relative to the waist belt and for transferring at least some of the weight of the pouch to the waist of the user proximate the hips of the user.

* * * * *